United States Patent [19]

Potthast

[11] 4,282,692

[45] Aug. 11, 1981

[54] PRECAST CONCRETE BUILDING CONSTRUCTION

[76] Inventor: Richard H. Potthast, 5625 Tall Oaks Rd., Waunakee, Wis. 53597

[21] Appl. No.: 962,985

[22] Filed: Nov. 22, 1978

[51] Int. Cl.[3] ..... E04B 5/02; E04B 1/58

[52] U.S. Cl. ..... 52/236.3; 52/252; 52/283; 52/648

[58] Field of Search ..... 52/236.6, 283, 252, 52/299, 648, 697, 730, 236.3

[56] References Cited

U.S. PATENT DOCUMENTS

| | | | |
|---|---|---|---|
| 1,591,077 | 7/1926 | Besse | 52/648 |
| 2,783,638 | 3/1957 | Henderson | 52/252 |
| 3,074,209 | 1/1963 | Henderson | 52/252 |
| 3,890,759 | 6/1975 | Selden | 52/730 |

*Primary Examiner*—John E. Murtagh

*Attorney, Agent, or Firm*—Keith Schoff

[57] ABSTRACT

Precast reinforced concrete girder pairs are placed to pass in parallel along either side of multi-story poured-in-place reinforced concrete building construction columns and be supported on haunches or be keyed to the columns, and are fastened in face-to-face contact to provide a rigidly braced, evenly loaded and easily fabricated skeletal building structure.

6 Claims, 5 Drawing Figures

PRECAST CONCRETE BUILDING CONSTRUCTION

FIELD OF INVENTION

Multi-story, poured-in-place reinforced concrete building columns are joined at each floor level by beams or girders which brace and transmit floor loads to the columns. The beams or girders may pass in pairs on either side of the columns in continuous manner to provide both rigid column bracing and even distribution of floor loading.

PRIOR ART

U.S. Pat. No. 2,783,638 shows extended lengths of vertically facing precast reinforced concrete girders which are placed in pairs abutting opposite planar faces of a line of columns and are retained in place either by being pinned on upstanding dowels embedded in haunches which extend from the columns only in the axial directions of the girders or by bolts which pass laterally through the columns and paired girders and through which floor loading is transmitted from the girders to the columns by stressing the bolts in shear. U.S. Pat. No. 3,074,209 shows end-notched precast reinforced concrete girders placed to abut end-to-end on column haunches and be joined into continuous lengths by the exposed ends of aligned reinforcing rods being welded together.

The prior art showing requires column girdling beams and girders to be secured on muti-story high columns either by fastening or positioning with mechanical means disposed in or through the columns or by fabrication operations performed in locations too spacially restricted and conjested by the proximity of columns and adjacent members to afford a proper environment for the performance and inspection of work.

SUMMARY OF THE DISCLOSURE

The skeletal structure of a multi-story reinforced concrete building is fabricated using longitudinally extending, vertically facing girder or beam pair members bolted face-to-face, clamped about and engaged in recessed belts about multi-story high reinforced concrete columns which may be further configured with haunches or keys projecting transversely through vertical planes interfacing the column and beam or girder members to form shoulders upon which the members bear. Fabrication such as bolting the member pairs together may be performed away and apart from the situs and operations involving the column, thus facilitating the ease and expedition and enhancing the quality of reinforced concrete building structure erection.

DESCRIPTION OF THE INVENTION

Figure 1:
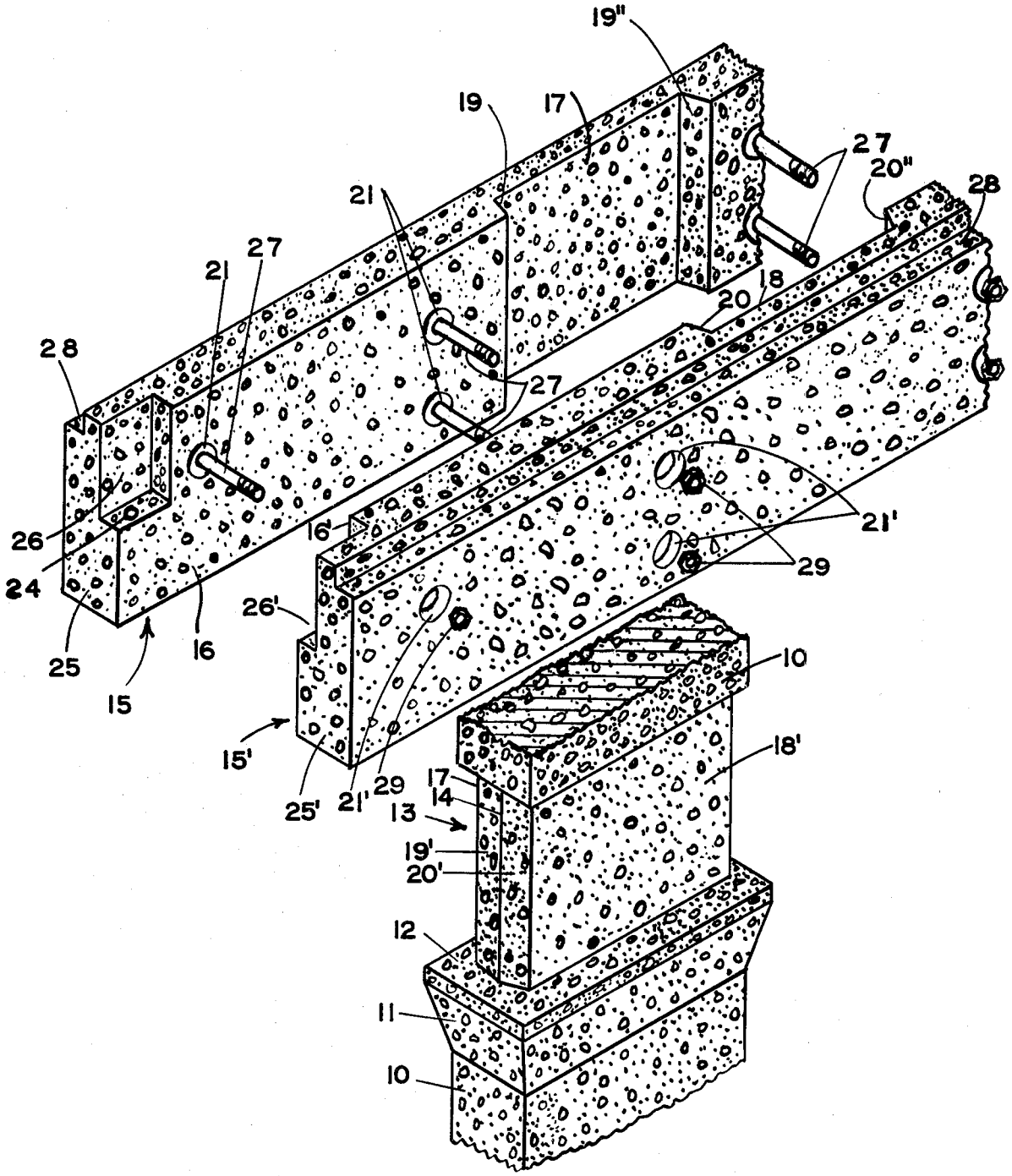
FIG. 1 is a perspective view showing a portion of a reinforced poured concrete column for building construction and a pair of girder members configured to be operably engaged with the column.

In FIG. 1 poured-in-place reinforced concrete column 10 is shown in partial extent and is configured with haunch 11 disposed with bearing surface 12 extending horizontally from the face of belted recess portion 13. The thickness of column 10 between planar faces 17' and 18' of portion 13 is of lesser dimension than that of column 10 either below haunch 11 or above portion 13. As shown end faces 19' and 20' of portion 13 are recessed from the plane of the normal endface of column 10 and are angulated slightly one to the other with apex line 14 being disposed in the centerline plane of column 10. Beam pair members 15, 15' are disposed for being placed with faces 16, 16' coextensively faying with faces 17', 18' of portion 13 of column 10, the two members 15, 15' being symmetrical, and if desired, indentically configured and interchangeable. Faces 17, 18, 19, and 20 of members 15, 15' respectively fay with surfaces 17', 18', 19' and 20' of portion 13 of column 10 providing thereby a close fitting girdler about column 10. Faces 19'' and 20'' of members 15, 15' similarly fay with corresponding surfaces of portion 13, which are hidden from view in FIG. 1.

Openings 21, 21' run transversely through members 15, 15', respectively, and are disposed in alignment for receiving fastening means, preferably bolts 27 as shown with nuts 29 secured thereon for clamping members 15, 15' into substantial contact and against faces 17', 18' of portion 13 of column 10. End faces 19, 19'', 20, 20'' members 15, 15' are similarly brought into near adjacency or faying contact with end faces of portion 13 such as 19', 20' and the irregularities between facing surfaces are preferably filled with grout or other caulking or bedding material applied to the column faces including face 12 before placing members 15, 15' in position on column 10.

End extremities 25, 25' of members 15, 15', respectively, are shown with recessed pockets 26, 26' configured to support the end extremity of a suspended beam or girder. While members 15, 15' may span a bay between columns, in usual practice unless such a span is relatively short, a simple beam is laid to bear upon and be supported on bearing surfaces laterally extending from the columns, members 15, 15' fulfilling such function. A suspended simple beam supported in pockets 26, 26' may be of lesser depth and width dimension than that of the beam fabricated from members 15, 15', however, any size beam may be end-sized to be carried in pockets 26, 26'. The opposite end extremities of members 15, 15' from those of 25, 25' may be configured in similar manner for receiving a simple beam end, or may be configured in any other operable manner suitable for the particular construction. Notches 28, 28' run along the top of the outside faces of members 15, 15' for receiving and carrying reinforced concrete slab which constitutes floor decking or precast decking or other floor material as may be provided. Haunch 11 is shown in FIG. 1 as a preferred embodiment of the invention, but may be eliminated from the embodiment of FIG. 1, if desired. Members 15, 15' are assembled about column 10 being engaged in belted recess portion 13 properly bedded in grout and bolted together with the heads of bolts 27 and with nuts 29 being recessed in countersinking provided in members 15, 15' and covered with grout; grout may also be provided between faces 16, 16' of members 15, 15' to bond and integrally unify the two members. Vertical opening 24 may optionally be provided to receive a centering or positioning pin, if desired.

Figure 2:
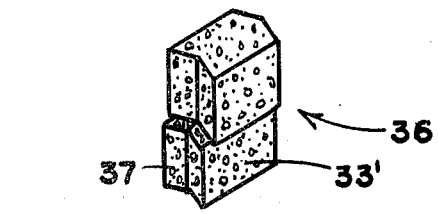
FIG. 2 is a perspective view showing a portion of a column together with a quoin and one member of a girder pair for being operably engaged with said column.
Figure 2:
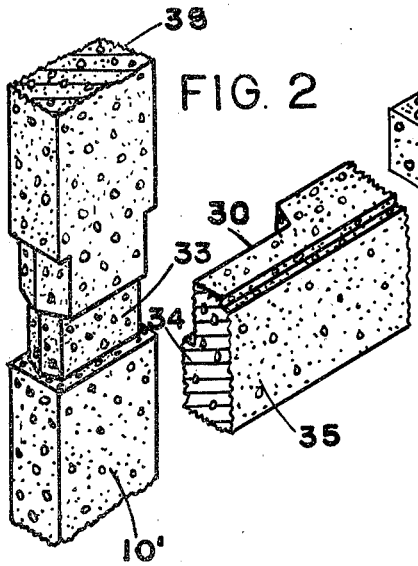

In FIG. 2, column 10' is shown as being of lesser width than column 10 of FIG. 1 such as might be used to define narrow bays. Belted recess portion 33, similar to portion 13 of FIG. 1, is of lesser height than beam member 35 and is defined at its lower extremity by a shoulder formed by an indentation into column 10' and not by a haunch as in FIG. 1. Beam member is one of a pair of symmetrical or identical members, the other beam member being omitted from showing in FIG. 2 for convenience. Face 30 of beam member 35 fays with the face of column 10' and key 34, which is integrally cast into beam 35, is operably received in belted recess portion 33 of column 10' thereby providing support for the beam member on the column. As shown, face 30 of beam member 35 extends beyond the width of column 10', but may operably be used with the beam member by inserting quoin 36 with key 37 being received in the transverse face of recess portion 33 and with keyway 33' disposed to receive key 34 ofbeam 35. Quoin 36 fills the unoccupied space of face 30 of beam 35 which projects beyond face 39 of column 10'. Assembly of beam member 35 with its paired member, not shown, is accomplished in similar manner to that described in relation to FIG. 1 Quoins can be used as necessary against either of the transverse faces of column 10', or against both faces, and may be used to fill space otherwise unoccupied and provide additional bearing surface for the beam members.

Figure 3:
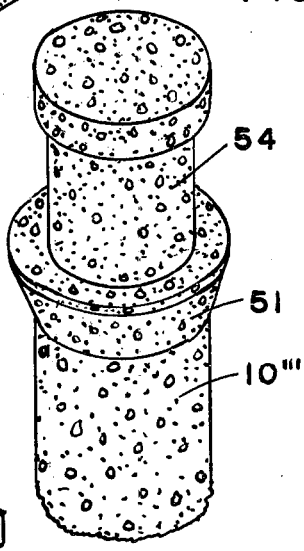
FIG. 3 is a perspective view of another embodiment of a column of this invention.
Figure 3:
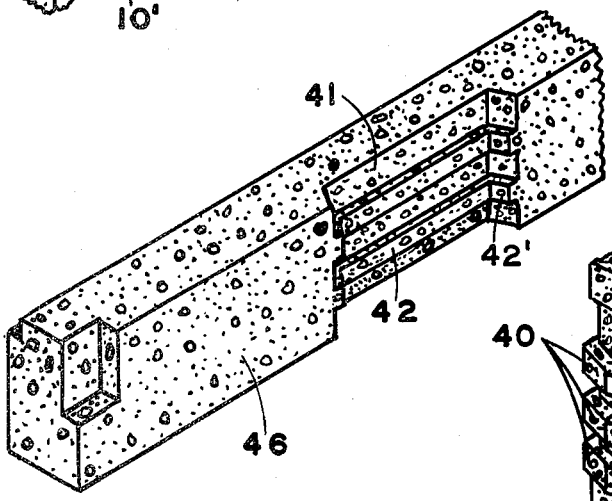
Figure 3:
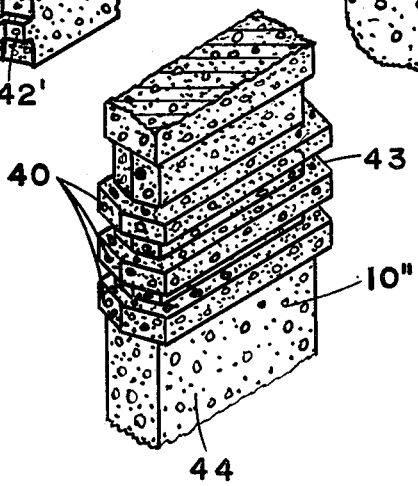

In FIG. 3, column 10'' is shown with keyways 43 recessed from the plane of face 44 and disposed between keys 40 which project laterally beyond the plane of face 44. Beam member 46, one of a pair of beam members arranged in manner similar to that shown in FIG. 1, but with the complementary member being omitted from showing in FIG. 3, is configured with keys 42 running the length of indented face 41 and terminating with portions 42' across the transverse face of column 10''. The beam members are assembled to girdle column 10'' in manner similar to that above described.

Figure 4:
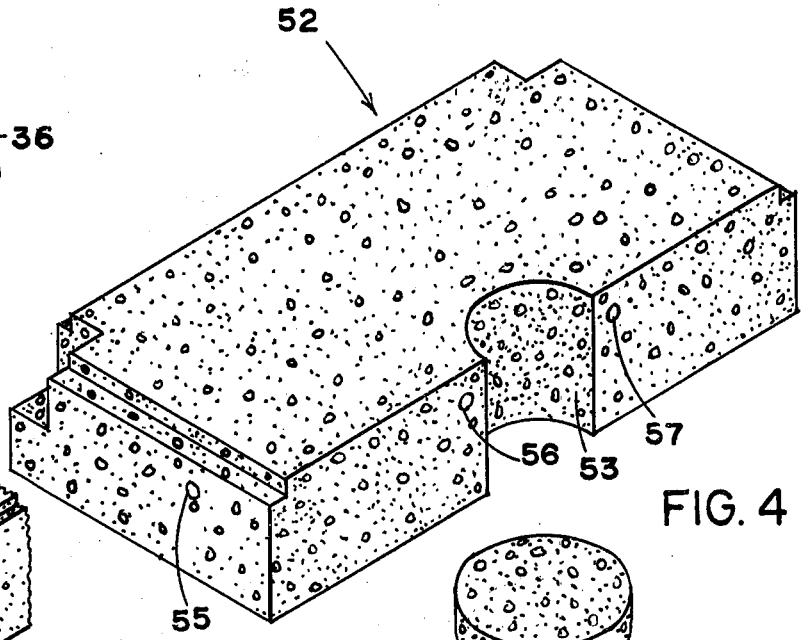
FIG. 4 is a perspective view of a portion of a round column of this invention and a cap for being placed thereon.

In FIG. 4 column 10''' is shown as round and provided with haunch 51 defining the lower boundry of portion 54 which is of lesser diameter than the rest of column 10''' and is operably configured to receive cap 52 with surface 53 faying with the surface of portion 54. Openings 55, 56, and 57 are provided through cap 52 for receiving tendons, not shown, for being fully tensioned in post construction stressing. Provision of tendons obviates the need for other fastening means being provided to secure cap 52 in place, however, other operable means may be used, if desired, for securing cap 52. An adjacent cap member, not shown, will be understood to be provided about column portion 54 in the manner described for other embodiments of this invention.

Figure 5:
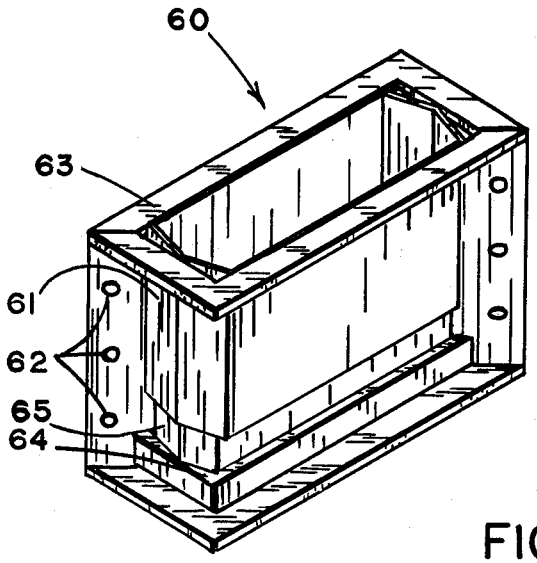
FIG. 5 is a perspective view of a form suitable for providing a poured concrete column of the configuration shown in FIG. 2.

FIG. 5 shows form 60 fabricated from metal sheet or plate, suitable for forming the portion of column 10' of FIG. 2 comprising belted recess portion 33. Two identical box angles 61 are shown for being bolted together through openings 62 to provide a removeable form which may be reused. Flanges 63, 64 are provided about the top and bottom edges, respectively, of form 60 for strengthening the edges and providing surfaces against which adjacent forms may be set. Inwardly projecting rib 64 formed in each of box angles 61 is configured with dihedral angle 65 at the center of the transverse face. Wood, treated cardboard or similar conventional materials may be used for the forms instead of metal, and other forms suitable for forming embodiments of other figures of this invention may be similarly made. Although preferred the draft angle shown in the drawings and represented by dihedral angle 65 in FIG. 5 may be eliminated, if desired, however, the provision of such an angle is useful not only in removing casting forms, but particularly in assisting in the proper positioning of beam members against columns during erection of a building.

The articles of this invention comprise vertically facing paired beam or girder members configured for being placed to continuously pass on either side of a continuous length of column and be engaged therewith in at least one recess which belts the column and which provides a horizontal bearing surface for supporting the horizontal members. Bearing surfaces may be provided by haunches or keys or both, and extend from the face of the column in a direction transverse to the axial direction of the beam or girder members. Columns may be configured with any desired cross sectional configuration such as round, rectilinear, polygonal, elliptical or other and be configured with keys and keyways which may be of the same or different configuration either completely belting the column or extending only along the axial directionof the girder or beam, and such girder or beam may be configured in complementary fashion or have more elongated key or keyway surfaces, in which case a quoin or quoins are desirably provided. Casting forms for girders, beams and columns configured in the manner described for this invention are within the scope of invention, the form shown in FIG. 5 being modified for casting of beams or girders by elimination of vertical flanges shown on the corners of box angles 61.

I claim:

1. In reinforced concrete building construction, the combination of (a) at least one reinforced multi-story concrete column configured with at least one bearing surface projecting substantially horizontally, defining in said column a configuration of the interface between transversely extending key-in-keyway groove, (b) at least one pair of elongated, horizontal pre-cast reinforced concrete beam members configured to comprise a configuration of the interface between transversely extending key-in-keyway groove complementary to that of said column and to bear upon said horizontal bearing surface conextensive with each other and vertically facing each other continuously past said column and faying with opposite faces of said column, (c) means securing said beam members substantially into interfacial contact.

2. The article of claim 1 wherein said bearing surface comprises the upper surface of a key configured in said column.

3. The article of claim 1 wherein said bearing surface comprises the lower surface of a keyway configured in said column.

4. The article of claim 1 comprising in addition at least one quoin disposed together with said column between faces of said beam members.

5. The article of claim 1 wherein said indented recesses comprise horizontal key members for engaging with keyways in said column.

6. The article of claim 1 wherein said indented recesses comprise horizontal keyways for being engaged with keys in said column.

* * * * *